United States Patent [19]

Smith et al.

[11] 4,191,444

[45] Mar. 4, 1980

[54] DEAD FRONT PLUG WITH STRAIN RELIEF

[75] Inventors: Donald F. Smith, Warwick, R.I.; Michael J. Ostrelich, Easton, Conn.

[73] Assignee: General Electric Company, New York, N.Y.

[21] Appl. No.: 974,174

[22] Filed: Dec. 28, 1978

[51] Int. Cl.[2] ..... H01R 13/58

[52] U.S. Cl. ..... 339/107; 339/62

[58] Field of Search ..... 339/107, 59 R, 62, 166 R, 339/176 R, 195 R

[56] References Cited

U.S. PATENT DOCUMENTS

| | | | |
|---|---|---|---|
| 2,192,737 | 3/1940 | Folsom | 339/107 |
| 4,067,634 | 1/1978 | Hoffman | 339/107 |

*Primary Examiner*—Roy Lake
*Assistant Examiner*—DeWalden W. Jones
*Attorney, Agent, or Firm*—Paul E. Rochford; Walter C. Bernkopf; Philip L. Schlamp

[57] ABSTRACT

A dead front plug is provided having an insulating housing with the general configuration of a valise. The electric cord enters the housing from the top of the valise. Strain relief is provided integral with the housing and comprises an annular channel around which the separated strands of the wire is directed. Radially extending pairs of walls in opposite sides of the valise press the two wire arcs into generally sinusoidal configuration along the length of each arc. Secure wire retention and strain relief is achieved.

6 Claims, 10 Drawing Figures

DEAD FRONT PLUG WITH STRAIN RELIEF

CROSS-REFERENCE TO RELATED APPLICATIONS

The subject application is related to the following copending applications all of which are assigned to the same assignee as the subject application.

Ostrelich, Smith and Mellyn, Ser. No. 972,741, filed Dec. 26, 1978, entitled "DESIGN FOR A TWO PRONG ELECTRIC PLUG".

Smith, Ostrelich and Mellyn, Ser. No. 973,654, filed Dec. 26, 1978, entitled "DESIGN FOR HEAVY DUTY ELECTRIC PLUG".

Ostrelich and Smith, Ser. No. 974,173, filed Dec. 28, 1978, entitled "INTERLOCK OF BLADE AND HOUSING SIDE".

Smith and Ostrelich, Ser. No. 974,172, filed Dec. 28, 1978, entitled "DEAD FRONT PLUG WITH INSULATION PENETRATING CONTACTS".

BACKGROUND OF THE INVENTION

The present invention relates to an electrical connector and more specifically to a connector which has a so-called "dead front" construction.

Electrical connectors which have dead front construction have no exposed parts to which wires are attached other than the electric blades which are to receive power from a receptacle or the openings to the contacts of a receptacle itself.

The concept of the use of a dead front type of construction is that it increases the safety associated with the use of connectors including both plugs for receiving electric power and receptacles for delivering electric power to plugs. In prior art devices there was access to the screws to which wires were connected through the face of the plug having the power blades extending therefrom. For many such prior art plugs there were various forms of covers that were to be placed over the face and to have the blades extending through the cover, but these covers were not always employed by the users of the plug so that when the cover was absent the screws to which wires were attached were accessible from the face. Further, any wire attached to the screws which became loose or unravelled could extend out from the plug to make contact with a user or with a metal plate into which the plug was inserted.

In recent times the standard making organizations of this country and particularly the Underwriters Laboratories has studied this problem and has determined that connectors, and particularly plugs, should have a dead front construction. The mandating of the use of dead front plugs by UL was the subject of a standard and this standard is now in force.

One patent which describes a dead front plug construction is the Hoffmann U.S. Pat. No. 4,010,999. The construction of the plug of this patent is of the so-called "valise" type. Such a valise type construction was known prior to the Hoffmann patent and was in fact shown and described in British Pat. No. 676,144.

OBJECTS OF THE INVENTION

It is an object of the present invention to provide an electrical connector which is economical in manufacture and reliable in use.

Another object is to provide an electrical connector having an effective means for avoiding detachment of the electric supply wire therefrom.

Another object is to provide an electrical connector having a valise type of construction and which is closed with a single fastener with strong retention of the electric supply conductor.

Another object is to provide an electrical connector which has valise type construction and a single screw to close the connector to achieve strong retention of the electrical conductor in the wire gripping portion thereof.

Other objects and advantages of the present invention will be in part pointed out and in part apparent in the description which follows.

BRIEF STATEMENT OF THE INVENTION

The present invention is concerned with a wire connector having a dead front type construction as this term is understood in the art. The article is made up of a valise style insulating housing and electrical contacts mounted within the housing. A single fastener element closes the sides of the insulating valise type housing together. Where the fastener is a screw member the screw extends through a hole having an internal collar formed in one side of the valise insulating housing and into a generally annular socket in the other side of the valise housing. Surrounding the annular reinforcement for the fastener is a generally annular wire channel into which the electric supply wire is fitted. Radial ribs lying across the channel provide wire restraining grippers to hold the wire from sliding out of the channel when a pull is applied to the free end of the wire outside of the connector. The set of radial ribs crossing the annular wire channel is present in the wire channel on each side of the valise sides of the valise type housing so that as the wire is restrained and retained within the channel where the housing is assembled and the fastener is secured in place. The wire is gripped and retained by both its curvature around the annular channel and also by the radial ribs located within both halves of the channel.

BRIEF DESCRIPTION OF THE DRAWINGS

The present invention will be better understood by reference to the accompanying drawings in which.

DESCRIPTION OF THE PREFERRED EMBODIMENT

With reference to the FIGURES structural details and features of the present invention are pointed out.

Figure 1:
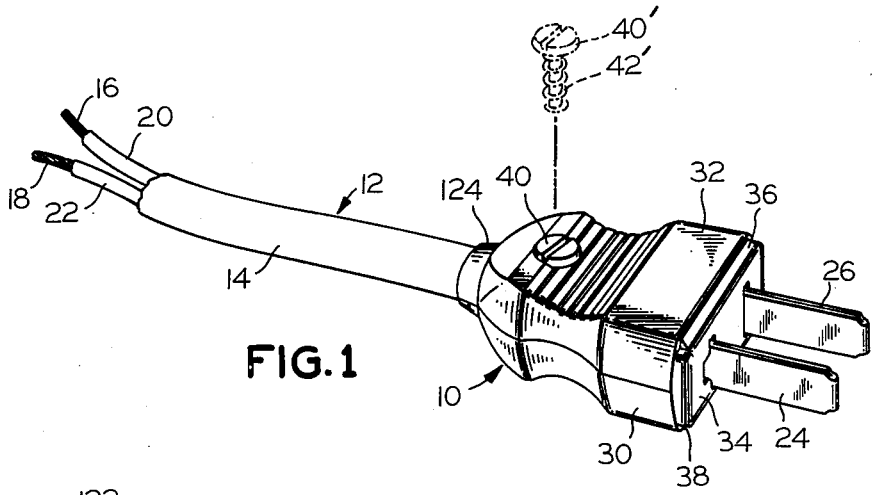
FIG. 1 is a perspective view of a plug and power supply wire as provided pursuant to the present invention.

In FIG. 1 a plug as provided pursuant to the present invention is illustrated in perspective view. The plug 10 is provided with a power supply conductor 12. The conductor has an outer insulation 14 covering two inner wires 16 and 18, each of which is provided with insulating sheaths 20 and 22. For essentially all connectors of the present invention, provision is made for receiving and retaining a conductor, such as 12, in the mechanism of the connector and for making electrical connection within the device between the conductors 16 and 18 and the electrical contacts of the device. In the case of plug 10 the contacts have the external power blades 24 and 26 which are connected respectively with the conductors 16 and 18.

The insulating housing into which the blades 24 and 26 as well as the wire 12 enters is a plastic insulating housing made up of three portions, two of which are side portions 30 and 32, and the other of which is a base portion 34. The side and base portions are connected by thin sections of the material which serve as webs or hinges 36 and 38. The two side portions 30 and 32 are held together by a screw member, the head of which 40 is shown in place in side 30 of housing 10. The screw head 40 is shown in phantom as 40', which with its shank 42', is poised directly above the hole in housing 10 where screw 40 is positioned to close sides 30 and 32 of the housing 10.

Figure 2:
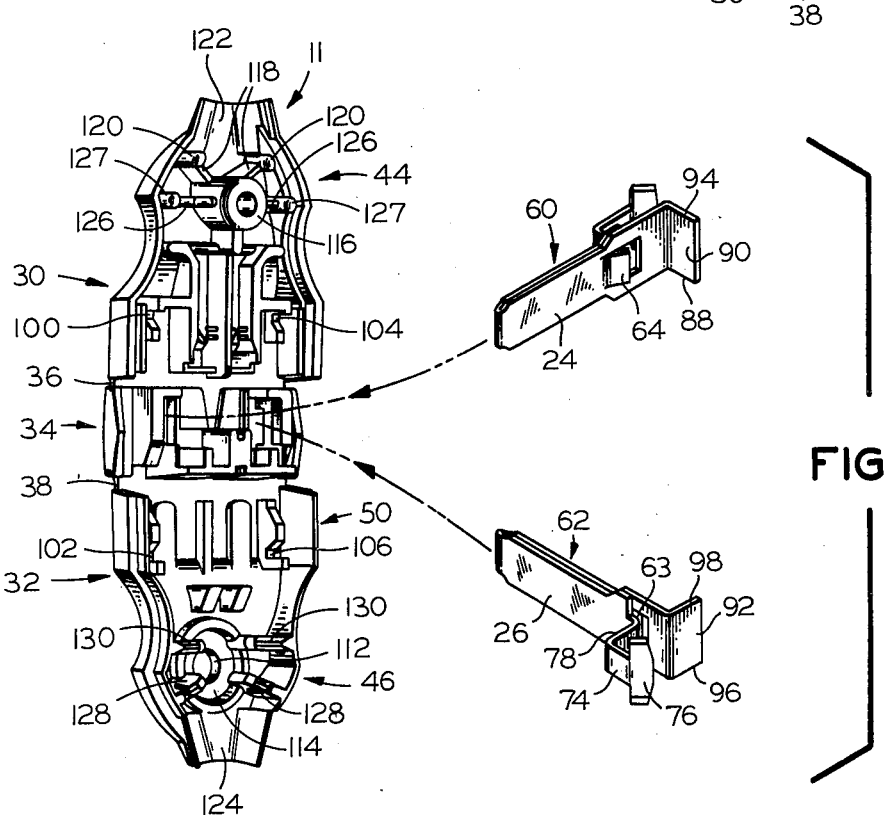
FIG. 2 is a perspective side view of the housing of the plug of FIG. 1 shown in an opened position with power blades poised for entry into the housing.

Referring next to FIG. 2, the insulating housing 11 of plug 10 is shown in an opened position with a perspective view of the interior thereof, and with the power blades 24 and 26 of the contacts 50 and 52 shown poised for insertion into receiving openings in the base 34 of the housing 11. The side portions 30 and 32 of the housing 11 are made up of cord restraining portions 44 and 46 near the point where the cord enters housing 11 and contact retaining portions 48 and 50 adjacent to the respective cord retaining portions. The base 34 is also adjacent to the contact retaining portions 48 and 50.

This base 34 receives the two contacts 60 and 62 as the blades 24 and 26 respectively are inserted through the base to occupy the position illustrated in FIG. 1.

Figure 3:
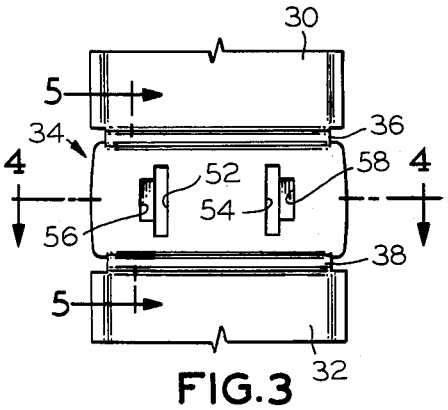
FIG. 3 is a partial plan view of the exterior of the housing of the plug of FIG. 1 also shown in an opened position.
Figure 4:
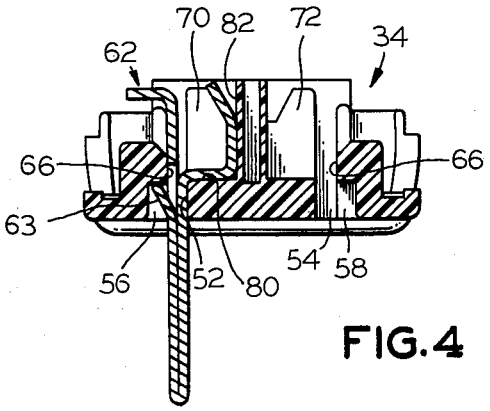
FIG. 4 is a sectional view taken along the line FIG. 4—4 of FIG. 3.
Figure 5:
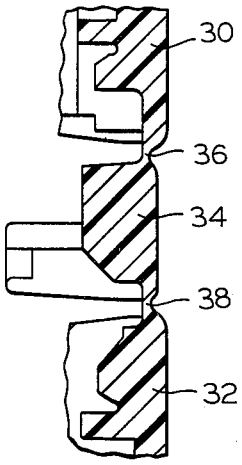
FIG. 5 is a sectional view taken along the line FIG. 5—5 of FIG. 3.

The base 34 is illustrated from the bottom in FIG. 3 with the webs 36 and 38 extending out from the base 34 to portions of the side structures 30 and 32. The blade ports 52 and 54 are the ports through which the blades 24 and 26 are inserted during assembly of the connector 10. The two latch wells 56 and 58 adjacent to the blade ports 52 and 52 respectively receive and hold a latch element as will be described below. The portion of the housing illustrated in FIG. 3 is shown in section in FIGS. 4 and 5. The FIG. 4 is a transverse sectional view taken along the lines 4—4 of FIG. 3 and showing the base 34 in vertical section. FIG. 5 is a longitudinal sectional view taken along the line 5—5 of FIG. 3 and showing the base 34 and adjoining portions in section.

It will be noted particularly from contact 60 of FIG. 2 that a latch is formed by stamping the tab 64 out of the portion of contact 60 which portion is immediately above the elongated blade portion 24. The blade 24 is inserted through the blade port 52 in the manner illustrated in FIG. 2 and as is evident from FIG. 4 such insertion will bring the tab 64 into the latch well 56 after the tab has been compressed and squeezed by the well wall 66.

As is also evident from FIG. 4, the base 34 is also provided with internal wells 70 and 72. The contact 62 has an offset arm 74 which holds the bladed end 76 of the contact 62. The offset arm 74 extends from the main axis of the contact 62 by a cross arm 78. The cross arm 78 seats within the internal well 70 on the platform 80 at the bottom of well 70. The offset arm 74 may rest against the internal side wall 82 of well 70. Similarly the contact 60 is situated in the port 54, latchwell 58 and internal well 72 of base 34 in essentially a mirror image fashion to the situation of contact 60 in the base 34. It is evident from consideration of the configuration of the contacts 60 and 62 as well as the internal and external wells of the body 34 that when the contact is inserted in place in the base, the blade will extend out of the base for its normal purpose of insertion into a receptacle. Accordingly the contact itself will be precisely located within and held within the base 34 in a position which cannot be easily altered independently of whether or not a wire has been assembled to the device and whether or not the device has been assembled as illustrated in FIG. 1. For example, the tendency of the blade to be forced out of the base 34 as the blades are inserted into a receptacle is resisted by the tab 64 pressing against the upper wall of the well 56 and 58. Conversely where the tension is applied to the outwardly extending blade portions 24 and 26 the blade cannot be moved out of its place in the base 34 due to the cross arm 78 of the contact abutting against the platform 80 at the bottom of the internal well 70 of base 34.

The firm securing of the blade in the base is accomplished prior to any assembly of the sides of the housing 11. Accordingly, the combination of the configuration of the contacts taken together with the configuration of the base 34 provides a result which permits the connector to be assembled and contact to be made with conductors positioned therein with great ease of manufacture and assembly and with great reliability of operation and performance. The illustration of the contacts fully assembled into the base 34 is given in FIG. 10 which is a top plan view of the fully opened connector with the contacts pressed into place and held firmly in place in the base 34 of the connector.

Figure 6:
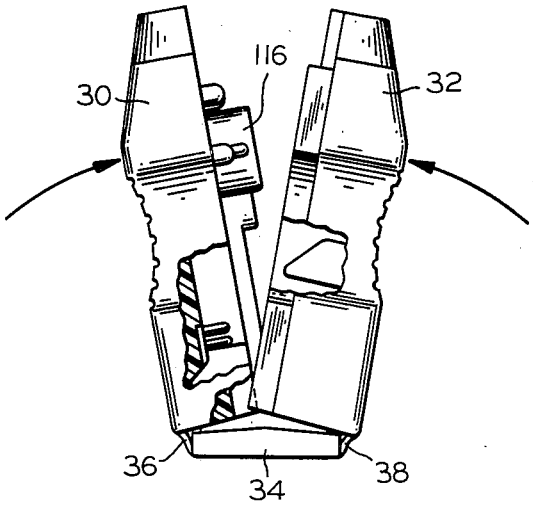
FIG. 6 is an end elevation of the insulating housing of the plug as illustrated in FIG. 1 in part broken away and showing the housing in a partially opened position.

Turning now to FIG. 6, there is illustrated a side elevational view in part broken away and in section of a fold up housing 11 being folded in valise fashion to close the two sides of the housing 30 and 32 together above the base 34. The folding action takes place based on the high flexibility of the web or hinge portions 36 and 38.

Figure 7:
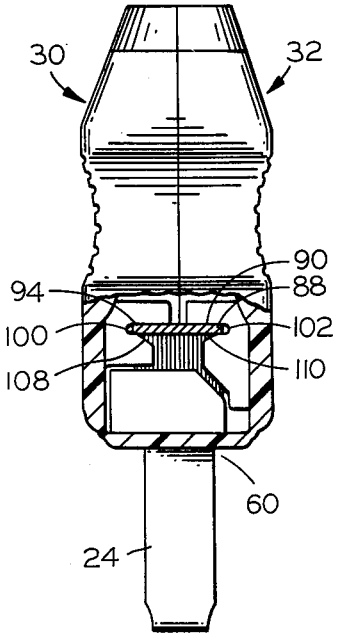
FIG. 7 is an end elevational view similar to that of FIG. 6 with the housing shown in the closed position and with the housing partially broken away to show a portion of the interior thereof.

In FIG. 7 the side elevational view of the folded connector and blade combination of the present invention, in part broken away, is illustrated with the power blades in place. In this illustration the blade 26 extends downward from the base 34 of the closed housing 10. Once the housing is closed the blade is anchored in place extending from housing 10 by the upper tab 108.

It will be noted accordingly that there is provided a wiring device which may operate in the opened condition, and prior to the assembly or full assembly of the device into the final closed condition as illustrated in FIG. 1.

In FIG. 2 the contacts 60 and 62 are illustrated in their position poised for entry into the base 34. Once the contacts are inserted in place they are firmly retained as part of the base and independent of the support and assistance of the two side portions 30 and 32 of the valise-like structure of the housing 11 of the connector. Accordingly, while the sides 30 and 32 of the valise do lend substantial assistance and support to the contacts, the base is able to operate and the combination of the housing 11 and the contacts 60 and 62 serve as a functioning unit for attachment of a wire such as 12 thereto in a manner to be described below. However, as furnished to the public, the unit comprises the insulating body 11 with the contacts 60 and 62 mounted therein and with an assembly screw 40 provided for the assembly of the unit to a wire. The unit is self-sufficient in carrying with it all of its essential ingredients and in enabling the potential user to take advantage of the novel features thereof without any equipment beyond a conventional screwdriver which is employed conventionally in the assembly of most such structures.

An interlock is provided between the contacts employed within the structure and the inner side walls of the structure. By inner side walls is meant the side wall portion visible in FIGS. 2, 8 and 10 in particular, and to a more limited degree in the other FIGURES. For example, in FIG. 7 the mode of interlock is evident through the broken away portion of the lower part of the housing of the connector shown therein.

With regard to the interlock, this interlock is accomplished principally between the upper or inner ends 90 and 92 respectively of the contacts 60 and 62 as illustrated in FIG. 2, for example. More specifically, the interlock occurs between the edges 88 and 94 of upper end 90 and conforming slots in the portions 48 and 50 of the housing 11 and between the edges 96 and 98 of upper end 92 and other conforming slots in the portions 48 and 50 of the housing 11. Still more specifically, the edge 94 interlocks with slot 100 and edge 88 interlocks with slot 102. Similarly, edge 98 interlocks with slot 104 and edge 96 interlocks with slot 106.

The actual slots are provided with a ramp surface on one side as best seen perhaps in FIG. 7. Thus the slot 100 has ramp surface 108 and slot 102 has ramp surface 110. These ramp surfaces permit the easy entry of the edges 94 and 88 of the upper end 90 of the contact element 60.

It is noteworthy that the structure is one which permits a rapid, easy, automatic interlocking between the contacts mounted within the connector and the side walls of the connector. In this regard, the specially provided transverse portion at the upper ends of the contacts are adapted for entry in a transverse fashion into the sets of slots provided specifically therefor in the sides of the housing. Accordingly, if the webs 36 and 38, which are formed integrally with the housing as the housing itself is formed, are slit or otherwise separated to permit the side portions 30 and 32 to be separated from the base portion 34, the assembled connector will not suffer any separation of portions thereof inasmuch as the blades through their upper portions 90 and 92 provide an effective interlock with the slots 100, 102, 104 and 106. A longitudinal pull exerted either on the blades 24 and 26, or on the wire 12, of FIG. 1, will not result in a separation of the base 34 from the slides 30 and 32 due at least in part to the strong interlock formed between the ends of the contacts as set forth above and the slots into which they are automatically positioned as the connector is assembled. This assembly of the sides 30 and 32 of the connector up and about the ends 90 and 92 of the blades is accomplished as is indicated above as the sides 30 and 32 are folded up and valise fashion above the base 34 to enclose the contents of the connector 10 including the exposed portions of the wire and the inner ends of the blade from contact with the hands of the user or with instruments or tools which the user may be employing in working with the connector.

As the sides of the valise style housing are folded up the two wire gripping portions 44 and 46 of the housing are brought into position to engage and retain in place a pair of insulated conductors. As indicated above a single screw 40 when screwed into place as illustrated in FIG. 1 actually holds the two valise sides together and provides for engagement of the contact elements and the valise sides.

The single screw 40 extends through the screw opening 112 of cord restraining portion 46 of side 32 of housing 11. Opening 112 is centrally positioned in a well 114 into which collar 116 of portion 44 of side 30 fits as the two sides are brought together as the housing is closed. Collar 116 is formed integrally with and extends up from side 30. Also collar 116 has a pair of cord restraining walls 118 extending out from the collar to posts 120 formed at the opposite ends of walls 118. The walls 118 and posts 120 are aligned radially outward from collar 116 and are located generally at the entrance half collar 122 at the end of side 30. A corresponding entrance half collar 124 is provided at the opposite end housing 11 so that the two half collars form a full collar about an entering insulated wire such as 12 when the device is assembled.

Also extending radially outward from collar 116 is a second pair of walls 126. These radial walls terminate in the pair of posts 128. Accordingly there are two pairs of radially extending walls extending from collar 116 and having posts formed at the ends of the walls.

At the opposite end of housing 11 two additional pairs of walls 128 and 130 are disposed extending generally outward from the well 114. The pairs of walls 128 and 130 are not aligned to confront the pairs of walls 118 and 126. Rather the opposing pairs of walls are displaced radially from each other to permit a wire pressing against one of the walls to be pressed into the recess between the two opposing walls. Accordingly a wire engaging the surface of a wall 128 for example will be pressed into the recess between the walls 118 and 126 at the opposite end of housing 11.

It is by the combination of radially extending walls, displaced radially from each other together with the winding of a wire about the collar 116 that a firm secure grip on the wires held within section 44 and 46 of the housing is achieved. The manner in which the walls are displaced in pairs from the opposing walls to give the captive wire a sinusoidal form along a curve extending around collar 116 is illustrated best perhaps in FIG. 8.

Figure 8:
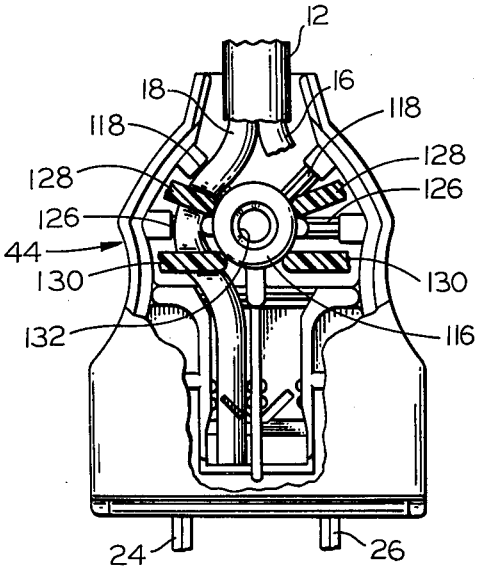
FIG. 8 is a side elevational view of the plug of FIG. 1 with portions broken away to illustrate the relationship of the parts therein.
Figure 9:
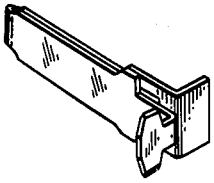
FIG. 9 is a perspective view of a power blade as used pursuant to the present invention.

Considering the illustration of FIG. 8 the insulated wire 12 enters entrance collar 122 and is unsheathed to expose the two insulated wires 16 and 18. Wire 16 is interrupted so that the array of opposing walls 118, 128, 126 and 130 are seen. On the left the wire 18 is seen to be positioned forward of walls 118 and 126 and to be positioned behind walls 128 and 130. In addition wire 18 follows a curved path around collar 116. In other words insulated wire 18 is held by its insulation both by the curving of the wire around collar 116 and by curving the wire over and under the series of walls extending out radially from collar 116. The wire follows a generally sinesoidal path over and under walls 118, 128, 126, and 130 and is also curved around collar 116. It is this combination of curvatures which makes it feasible for the wire restraining means of this invention to gain and maintain such a firm grip and to provide such a good strain relief for the wire.

The clamping of the two halves together is accomplished first by hand pressure on the plug housing sides and is then strengthened by the threading of the screw 40 into the screw hole 132.

In FIG. 6 the manner in which the housing halves are closed is illustrated. The collar 116 is seen to extend out from side 30 to a length to receive and hold shank of screw 40 (best seen in FIG. 1).

Figure 10:
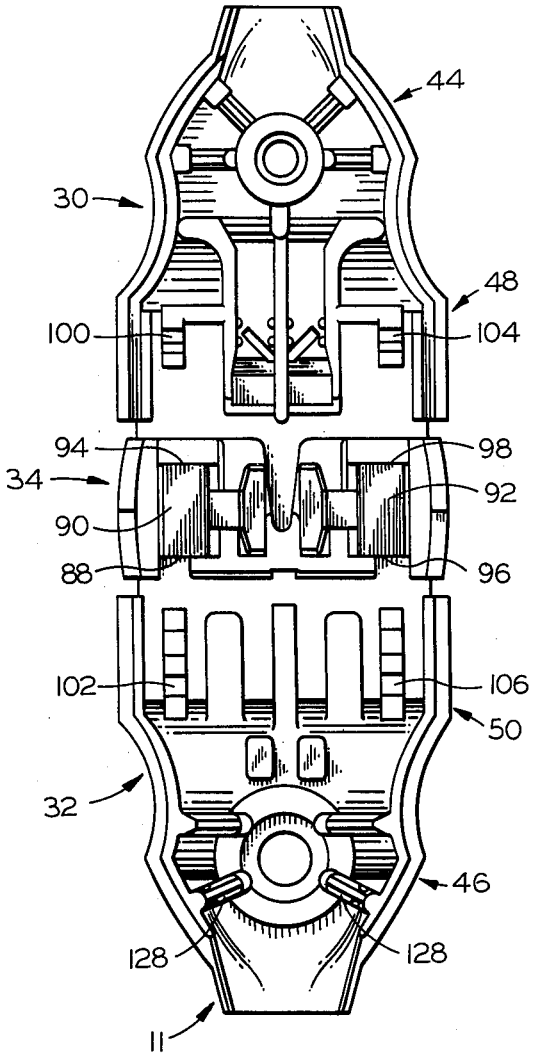
FIG. 10 is a top plan view of the insulating housing of the plug of FIG. 1 showing the housing in a fully opened position to view the interior thereof.

In FIG. 10 a more detailed view is provided of the various parts and portions as discussed above. One feature seen best in FIG. 10 is the groove in the walls 128. These grooves permit a portion of the wall to be pulled away by a user of the plug by use of a pair of pliers. The pliers are used to grip the wall 128 and by turning, twisting and pulling on the pliers a portion of each wall 128 may be removed. The removal of a portion of walls 128 permits a wire having double thick insulation to be held firmly and reliably by the cord grip and strain relief of this invention.

We claim:

1. A strain relief for a plug, said strain relief comprising:

an insulating housing in three aligned connected sections, the two end sections folding up in valise formation, an annular channel in each end section, said annular channel being disposed about a fastener opening extending through the center portion of said annular channel, a fastener to force said sections together and radially extending ribs in said annual channel, the ribs of one channel being offset from those of the opposite channel whereby a wire restrained in the said channel is given a sinusoidal configuration around an arc of said channel.

2. The strain relief of claim 1 in which the fastener is a screw.

3. The strain relief of claim 2 in which an upstanding collar is formed integrally in the housing section opposite the fastener opening to receive the threaded shank of the screw.

4. The strain relief of claim 1 in which the housing is of insulating plastic having living hinge property.

5. The strain relief of claim 4 in which the housing is of polypropylene.

6. The strain relief of claim 1 in which a first wire is located in one half the annular channel and a second wire is located in the other half of the annular channel.

* * * * *

UNITED STATES PATENT AND TRADEMARK OFFICE

CERTIFICATE OF CORRECTION

PATENT NO. : 4,191,444

DATED : March 4, 1980

INVENTOR(S) : Donald F. Smith and Michael J. Ostrelich

It is certified that error appears in the above-identified patent and that said Letters Patent are hereby corrected as shown below:

Column 1, line 60, first occurence, delete "valise" and insert --clam shell-- lines 60 through 62, delete the sentence beginning with "Such a valise---." and substitute --A related form of construction was shown in British Patent No. 676,144.--

Column 2, line 5, delete "valise" and insert --clam shell-- line 9, delete "valise" and insert --clam shell-- line 21, delete "valise" and insert --clam shell-- line 26, delete "valise" and insert --clam shell-- line 28, delete "valise" and insert --clam shell-- line 36, both occurences, delete "valise" and insert --clam shell--

Column 4, line 52, delete "valise" and insert --clam shell--

UNITED STATES PATENT AND TRADEMARK OFFICE

CERTIFICATE OF CORRECTION

PATENT NO. : 4,191,444

DATED : March 4, 1980

INVENTOR(S) : Donald F. Smith and Michael J. Ostrelich

It is certified that error appears in the above–identified patent and that said Letters Patent are hereby corrected as shown below:

Column 5, line 6, delete "valise" and insert --clam shell--
line 7, delete "valise" and insert --clam shell--
Column 6, line 4, delete "valise" and insert --clam shell--
line 10, delete "valise" and insert --clam shell--
line 15, delete "valise" and insert --clam shell--
line 17, delete "valise" and insert --clam shell--
Column 8, line 5, delete "valise" and insert --clam shell--

Signed and Sealed this

*Seventh* Day of *July 1981*

[SEAL]

*Attest:*

RENE D. TEGTMEYER

*Attesting Officer*

*Acting Commissioner of Patents and Trademarks*